US008794435B1

(12) United States Patent
Marini et al.

(10) Patent No.: US 8,794,435 B1
(45) Date of Patent: Aug. 5, 2014

(54) GARMENT BOX

(75) Inventors: Quinto Alessandro Marini, Plainfield, IL (US); Patrick M. McDavid, Warrenville, IL (US); Carmichael Salandanan Galang, Bolingbrook, IL (US); Briana Marie Wiegele, Iron Mountain, MI (US); Matthew James Robke, Chicago, IL (US); Stefan Joseph Figurski, Novi, MI (US); Earl Stacey Lee, Jr., Lombard, IL (US)

(73) Assignee: United Parcel Service of America, Inc., Atlanta, GA (US)

( * ) Notice: Subject to any disclaimer, the term of this patent is extended or adjusted under 35 U.S.C. 154(b) by 404 days.

(21) Appl. No.: 13/366,960

(22) Filed: Feb. 6, 2012

Related U.S. Application Data

(60) Provisional application No. 61/441,351, filed on Feb. 10, 2011.

(51) Int. Cl.
*B65D 85/18* (2006.01)

(52) U.S. Cl.
USPC ..... 206/278; 206/279; 206/290; 229/166; 229/167

(58) Field of Classification Search
USPC ..... 206/278, 290, 279; 229/166, 167; 493/162
See application file for complete search history.

(56) References Cited

U.S. PATENT DOCUMENTS

| | | | | | |
|---|---|---|---|---|---|
| 1,455,063 | A | * | 5/1923 | Batts | 206/279 |
| 3,259,229 | A | * | 7/1966 | Brittingham | 206/289 |
| 3,337,030 | A | * | 8/1967 | Miller et al. | 206/290 |
| 3,999,657 | A | * | 12/1976 | Doskocil | 206/289 |
| 4,060,169 | A | * | 11/1977 | Hildebrand et al. | 206/289 |
| 4,098,399 | A | * | 7/1978 | Bethune et al. | 206/288 |
| 4,158,406 | A | * | 6/1979 | Feder | 206/279 |
| 4,318,472 | A | * | 3/1982 | Nauheimer et al. | 206/284 |
| 4,342,389 | A | * | 8/1982 | Bethune et al. | 206/288 |
| 4,416,371 | A | * | 11/1983 | Nauheimer | 206/289 |
| 4,773,533 | A | * | 9/1988 | Greene | 206/288 |
| 6,155,415 | A | * | 12/2000 | Runyan | 206/279 |

* cited by examiner

*Primary Examiner* — Tri Mai
(74) *Attorney, Agent, or Firm* — Alston & Bird LLP

(57) ABSTRACT

Various embodiments of the invention provided a garment box comprising a bottom panel and a container portion that includes a first side wall, a second side wall, a third side wall, and a fourth side wall. In particular embodiments, the garment box further includes a walled enclosure portion contiguous to the first side wall and comprising a first fold over panel, a second fold over panel, and a third fold over panel. In particular embodiments, the first and third fold over panels include holes located proximate a mid-point of the panels and the second fold over panel includes a slot. The holes are configured to support a rod that is inserted into the walled enclosure portion. The rod is configured to support one or more heads of clothes hangers inserted through the slot and hung on the rod to secure clothes placed in the container portion for shipping.

14 Claims, 11 Drawing Sheets

GARMENT BOX

CROSS-REFERENCE TO RELATED APPLICATIONS

This application claims the benefit of U.S. Provisional Application No. 61/441,351, filed Feb. 10, 2011, which is incorporated herein by reference in its entirety.

BACKGROUND OF THE INVENTION

There are many instances in which individuals wish to ship garments such as shirts, dresses, jackets, skirts, pants, etc. in a box through a common carrier and/or the post office. However, in many instances, boxes used for shipping garments are required to stay upright; otherwise the garments slide down in the box. As a result, the garments may become curled up, disarranged, disheveled, and/or wrinkled. Furthermore, if the garments are placed on hangers and the hangers are not properly secured to restrict or prevent the hangers from movement during shipping, the hangers may break, tear and/or score the garments in the box. Therefore, a need exists in the art for a box that allows for shipping of garments on hangers that secures the hangers so that the garments remain properly arranged in the box and the box may travel in any orientation during shipping.

BRIEF SUMMARY OF THE INVENTION

Various embodiments of the invention provided a garment box comprising a bottom panel and a container portion that includes a first side wall, a second side wall, a third side wall, and a fourth side wall. In particular embodiments, the first side wall, the second side wall, the third side wall, and the fourth side wall are adjacent to and at approximate right angles to the bottom panel. In addition, in various embodiments, the first side wall and the fourth side wall are on opposite sides of the bottom panel from one another and are substantially parallel to and facing one another and the second side wall and the third side wall are on opposite sides of the bottom panel from one another, are adjacent to the first side wall and the second side wall, and are substantially parallel to and facing one another.

Various embodiments of the garment box further include a walled enclosure portion contiguous to the first side wall. In these particular embodiments, the walled enclosure portion includes a first fold over panel comprising a hole located proximate a mid-point of the first fold over panel. The hole is configured to support a rod that is inserted into the walled enclosure portion on which one or more heads of clothes hangers are hung. In addition, the walled enclosure portion includes a second fold over panel adjacent an inside edge of the first fold over panel and at an approximate right angle to the first fold over panel. In particular embodiments, the second fold over panel comprises a transverse slot extending a width of the second fold over panel and located proximate a mid-point of the second fold over panel and approximately aligned with the hole located in the first fold over panel. The transverse slot is configured so that the one or more heads of the clothes hangers can be inserted and placed around the rod so that the one or more heads of the clothes hangers are secured during handling and shipping of the garment box.

Further, the walled enclosure portion includes a third fold over panel adjacent an inside edge of the second fold over panel and adjacent an outside edge of the first side wall and at an approximate right angle to the second fold over panel and the outside edge of the first side wall. In particular embodiments, the third fold over panel comprises a hole located proximate a mid-point of the third fold over panel, the hole configured to support the rod that is inserted into the walled enclosure portion on which the one or more heads of the clothes hangers are hung. In these particular embodiments, interposition of the first, second, and third fold over panels forms the walled enclosure portion such that: (1) the first fold over panel is positioned inside the walled enclosure portion and lays juxtaposition on top of the bottom panel; (2) the second fold over panel is positioned approximately perpendicular to the bottom panel and comprises a width that extends approximately from the bottom panel to a top of the walled enclosure portion; (3) the third fold over panel is positioned approximately parallel to and facing the first fold over panel and on an opposite side of the width of the second fold over panel from the first fold over panel; and (4) the hole in the first fold over panel and the hole in the third fold over panel are approximately aligned with one another so that the rod can be inserted into the hole in the third fold over panel and passed through the walled enclosure portion and come to rest in the hole in the first fold over panel.

In addition, in particular embodiments, the garment box further includes a second walled enclosure portion contiguous to the fourth side wall. In these particular embodiments, the second walled enclosure portion includes a first fold over panel comprising a hole located proximate a mid-point of the first fold over panel The hole being configured to support a rod that is inserted into the second walled enclosure portion on which one or more heads of clothes hangers are hung. In addition, the second walled enclosure portion includes a second fold over panel adjacent an inside edge of the first fold over panel and at an approximate right angle to the first fold over panel. The second fold over panel includes a transverse slot extending a width of the second fold over panel and located proximate a mid-point of the second fold over panel and approximately aligned with the hole located in the first fold over panel. The transverse slot is configured so that the one or more heads of the clothes hangers can be inserted and placed around the rod so that the one or more heads of the clothes hangers are secured during handling and shipping of the garment box.

Further, the second walled enclosure portion includes a third fold over panel adjacent an inside edge of the second fold over panel and adjacent an outside edge of the fourth side wall and at an approximate right angle to the second fold over panel and the outside edge of the fourth side wall. The third fold over panel comprising a hole located proximate a mid-point of the third fold over panel and configured to support the rod that is inserted into the second walled enclosure portion on which the one or more heads of the clothes hangers are hung. In these particular embodiments, interposition of the first, second, and third fold over panels forms the second walled enclosure portion such that: (1) the first fold over panel is positioned inside the second walled enclosure portion and lays juxtaposition on top of the bottom panel; (2) the second fold over panel is positioned approximately perpendicular to the bottom panel and comprises a width that extends approximately from the bottom panel to a top of the second walled enclosure portion; (3) the third fold over panel is positioned approximately parallel to and facing the first fold over panel and on an opposite side of the width of the second fold over panel from the first fold over panel; and (4) the hole in the first fold over panel and the hole in the third fold over panel are approximately aligned with one another so that the rod can be inserted into the hole in the third fold over panel and passed through the second walled enclosure portion and come to rest in the hole in the first fold over panel.

In particular embodiments, the garment box may further include a sealing mechanism configured to secure the rod inserted into the walled enclosure portion. For instance, in one particular embodiment, the sealing mechanism is configured to be placed over the hole in the third fold over panel to secure the rod inserted into the walled enclosure portion. In addition, in particular embodiments, the second fold over panel of the walled enclosure portion of the garment box may include a slit disposed at a terminal end of the transverse slot proximate the inside edge of the second fold over panel. In these particular embodiments, the slit is configured to provide space so that a head of a hanger can pass through the slit and be secured in the walled enclosure portion. Finally, in various embodiments, the garment box may include a strap configured to secure garments placed in the container portion of the garment box.

Various embodiments of the invention are also directed to methods for making a garment box. In these particular embodiments, the garment box includes a bottom panel and a container portion comprising a first side wall, a second side wall, a third side wall, and a fourth side wall, each adjacent to the bottom panel. The first side wall and the fourth side wall are on opposite sides of the bottom panel from one another, the second side wall and the third side wall are on opposite sides of the bottom panel from one another, and adjacent to the first side wall and the second side wall. In addition, the garment box includes a walled enclosure portion contiguous to the first side wall. The walled enclosure portion includes a first fold over panel comprising a hole located proximate a mid-point of the first fold over panel, a second fold over panel adjacent an inside edge of the first fold over panel and comprising a transverse slot extending a width of the second fold over panel and located proximate a mid-point of the second fold over panel and approximately aligned with the hole located in the first fold over panel, and a third fold over panel adjacent an inside edge of the second fold over panel and adjacent an outside edge of the first side wall and comprising a hole located proximate a mid-point of the third fold over panel.

In various embodiments, the methods comprise the step folding the first side wall, the second side wall, the third side wall, and the fourth side wall approximate right angles to the bottom panel so that the first side wall and the fourth side wall are substantially parallel to and facing one another and the second side wall and the third side wall are substantially parallel to and facing one another. In addition, the methods comprise the step of forming the walled enclosure portion by performing a number of sub-steps. In particular embodiments, the sub-steps include folding down the first fold over panel so that the first fold over panel is positioned inside the walled enclosure portion and lays juxtaposition on top of the bottom panel. In addition, the sub-steps include folding down the second fold over panel so that the second fold over panel is positioned approximately perpendicular to the bottom panel and comprising a width that extends approximately from the bottom panel to a top of the walled enclosure portion. Further the sub-steps include folding down the third fold over panel so that the third fold over panel is positioned approximately parallel to and facing the first fold over panel and on an opposite side of the width of the second fold over panel from the first fold over panel. As a result, in particular embodiments, the hole in the first fold over panel and the hole in the third fold over panel are approximately aligned with one another so that a rod can be inserted into the hole in the third fold over panel and passed through the walled enclosure portion and come to rest in the hole in the first fold over panel, and the transverse slot is configured so that one or more heads of clothes hangers can be inserted through the transverse slot and placed around the rod so that the one or more heads of the clothes hangers are secured during handling and shipping of the garment box.

In particular embodiments, the garment box may further include a second walled enclosure portion, contiguous to the fourth side wall, comprising a first fold over panel comprising a hole located proximate a mid-point of the first fold over panel, a second fold over panel adjacent an inside edge of the first fold over panel and comprising a transverse slot extending a width of the second fold over panel and located proximate a mid-point of the second fold over panel and approximately aligned with the hole located in the first fold over panel, and a third fold over panel adjacent an inside edge of the second fold over panel and adjacent an outside edge of the fourth side wall and comprising a hole located proximate a mid-point of the third fold over panel. In these particular embodiments, the methods further comprise the steps of forming the second walled enclosure portion by folding down the first fold over panel so that the first fold over panel is positioned inside the second walled enclosure portion and lays juxtaposition on top of the bottom panel, folding down the second fold over panel so that the second fold over panel is positioned approximately perpendicular to the bottom panel and comprises a width that extends approximately from the bottom panel to a top of the second walled enclosure portion, and folding down the third fold over panel so that the third fold over panel is positioned approximately parallel to and facing the first fold over panel and on an opposite side of the width of the second fold over panel from the first fold over panel. As a result, the hole in the first fold over panel and the hole in the third fold over panel are approximately aligned with one another so that a rod may be inserted into the hole in the third fold over panel and passed through the second walled enclosure portion and come to rest in the hole in the first fold over panel, and the transverse slot is configured so that one or more heads of clothes hangers may be inserted through the transverse slot and placed around the rod so that the one or more heads of the clothes hangers are secured during handling and shipping of the garment box.

In particular embodiments, the methods further include the step of inserting a rod in the hole in the third fold over panel of the first and/or second walled enclosure portions so that the rod passes through the walled enclosure portion(s) and comes to rest in the hole in the first fold over panel. In addition, in particular embodiments, the methods further include the step of securing the rod inserted into the walled enclosure portion with a sealing mechanism. For instance, in one particular embodiment, the rod is secured by placing a sealing mechanism over the hole in the third fold over panel to secure the rod inserted into the walled enclosure portion.

Finally, various embodiments of the invention are directed to a blank configured to be used to form a garment box. In these particular embodiments, the blank includes a bottom panel and a container portion comprising a first side wall, a second side wall, a third side wall, and a fourth side wall. The first side wall, the second side wall, the third side wall, and the fourth side wall are adjacent to and configured to bend at approximate right angles to the bottom panel. In addition, the first side wall and the fourth side wall are on opposite sides of the bottom panel from one another and are configured to be substantially parallel to and facing one another upon being bent and the second side wall and the third side wall are on opposite sides of the bottom panel from one another, are adjacent to the first side wall and the second side wall, and are configured to be substantially parallel to and facing one another upon being bent.

In particular embodiments, the blank further includes a walled enclosure portion contiguous to the first side wall. In these particular embodiments, the walled enclosure portion includes a first fold over panel comprising a hole located proximate a mid-point of the first fold over panel, a second fold over panel adjacent an inside edge of the first fold over panel and configured to bend at an approximate right angle to the first fold over panel, the second fold over panel comprising a transverse slot extending a width of the second fold over panel and located proximate a mid-point of the second fold over panel and approximately aligned with the hole located in the first fold over panel, and a third fold over panel adjacent an inside edge of the second fold over panel and adjacent an outside edge of the first side wall and configured to bend at an approximate right angle to the second fold over panel and the outside edge of the first side wall, the third fold over panel comprising a hole located proximate a mid-point of the third fold over panel.

Upon the blank being formed into the garment box, interposition of the first, second, and third fold over panels forms the walled enclosure portion such that the first fold over panel is positioned inside the walled enclosure portion and lays juxtaposition on top of the bottom panel. In addition, the second fold over panel is positioned approximately perpendicular to the bottom panel and comprises a width that extends approximately from the bottom panel to a top of the walled enclosure portion and the third fold over panel is positioned approximately parallel to and facing the first fold over panel and on an opposite side of the width of the second fold over panel from the first fold over panel. Further, the hole in the first fold over panel is configured to support a rod that is inserted into the walled enclosure portion on which one or more heads of clothes hangers are hung and the transverse slot is configured so that the one or more heads of the clothes hangers may be inserted and placed around the rod so that the one or more heads of the clothes hangers are secured during handling and shipping of the garment box. Finally, the hole in the third fold over panel is approximately aligned with the hole in the first fold over panel so that the rod can be inserted into the hole in the third fold over panel and passed through the walled enclosure portion and come to rest in the hole in the first fold over panel.

In particular embodiments, the blank is manufactured as a single piece. While in other embodiments, the blank is manufactured as at least two pieces.

BRIEF DESCRIPTION OF THE SEVERAL VIEWS OF THE DRAWING(S)

Having thus described the invention in general terms, reference will now be made to the accompanying drawings, which are not necessarily drawn to scale.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

I. Exemplary Garment Box Blank

Figure 1:
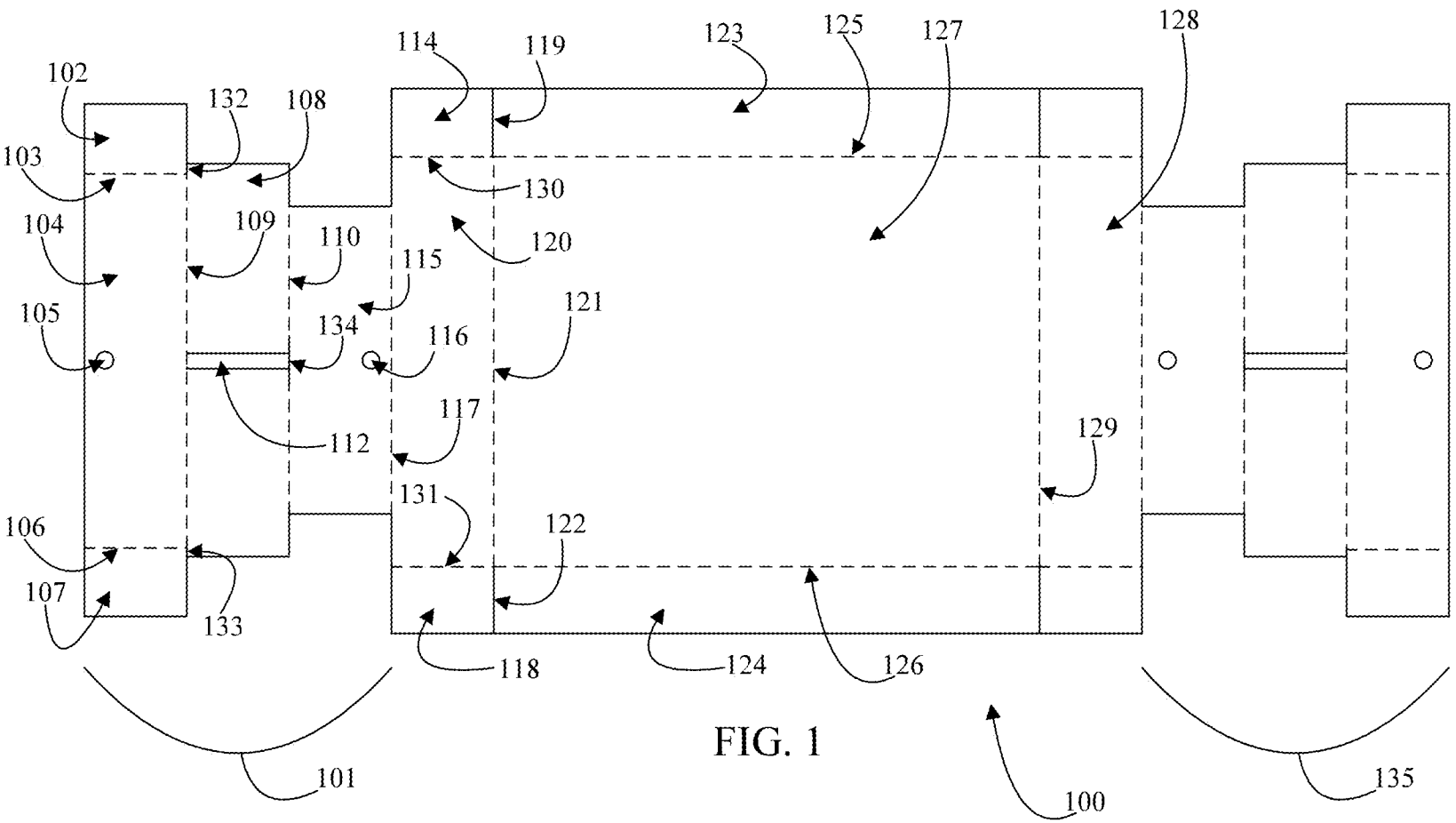
FIG. 1 shows a top view of an arrangement of a blank used to make a garment box according to an embodiment of the invention.
Figure 2:
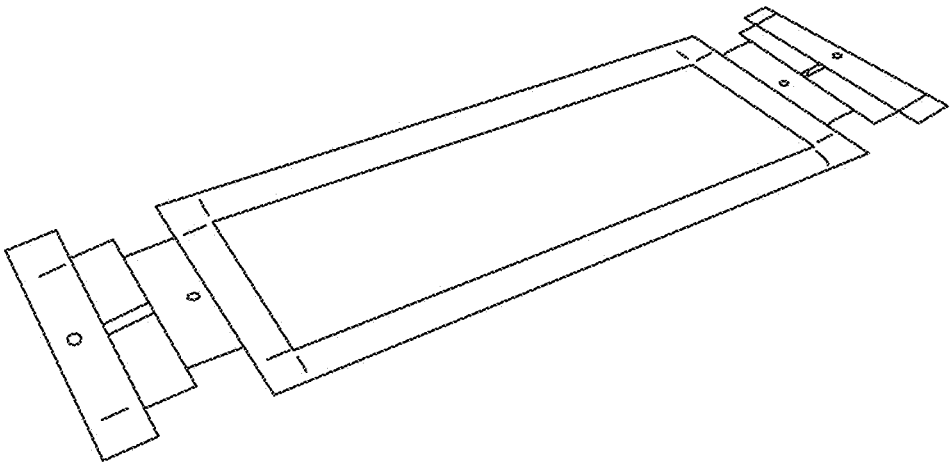
FIG. 2 shows a perspective view of a blank used to make a garment box during the assembly process according to an embodiment of the invention.
Figure 3:
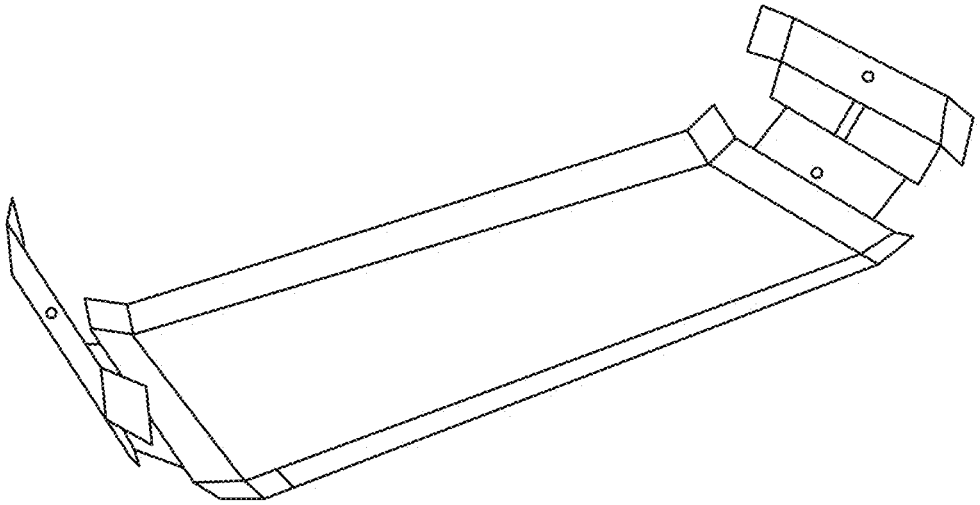
FIG. 3 shows a perspective view of the blank shown in FIG. 2 partially assembled into the garment box according to an embodiment of the invention.
Figure 4:
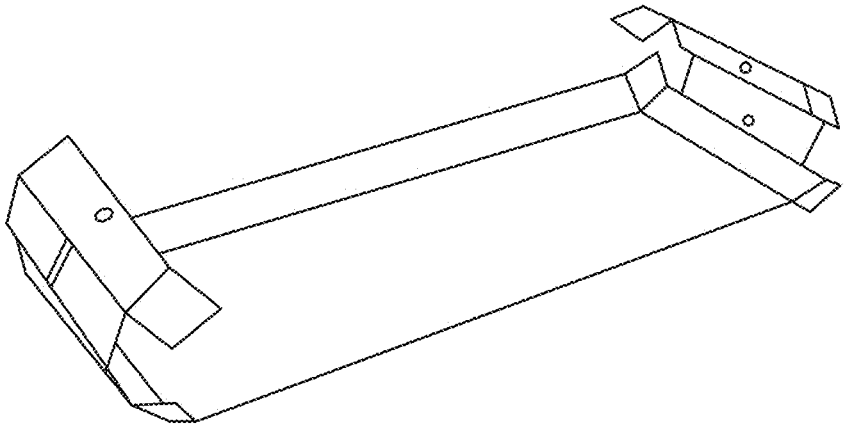
FIG. 4 shows a perspective view of the blank shown in FIG. 2 partially assembled into the garment box according to an embodiment of the invention.
Figure 5:
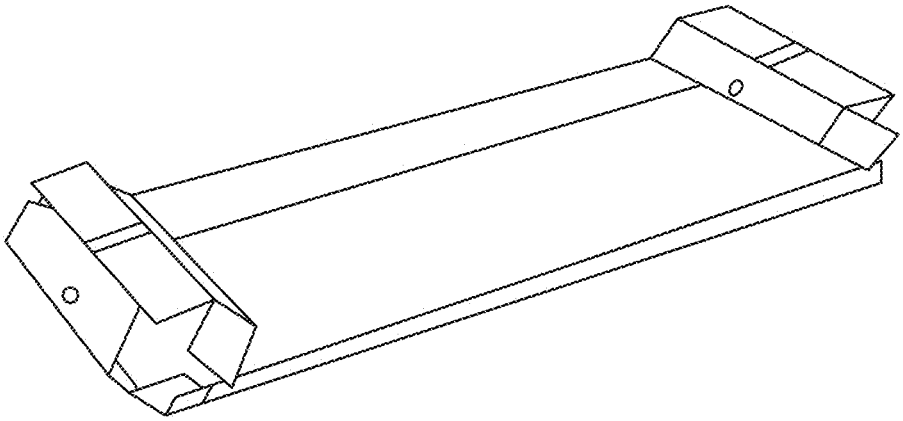
FIG. 5 shows a perspective view of the blank shown in FIG. 2 partially assembled into the garment box according to an embodiment of the invention.
Figure 6:
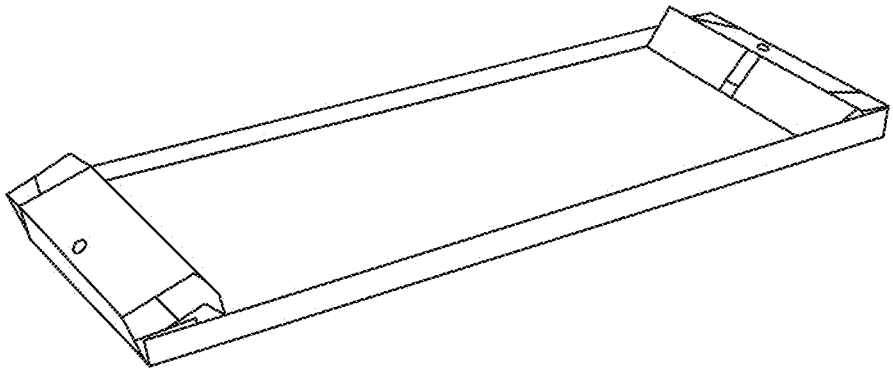
FIG. 6 shows a perspective view of the blank shown in FIG. 2 partially assembled into the garment box according to an embodiment of the invention.

FIG. 1 provides an illustration of a blank 100 that may be used to make a garment box according to an embodiment of the invention. In various embodiments, the garment box is formed by carrying out a sequence of folding steps upon the blank 100. In particular embodiments, the blank 100 is folded along appropriate crease lines and certain panels are thereby brought by the folding operation into proximity or juxtaposition to other panels or are made to abut or to interlock with other panels of the blank 100. In various embodiments, the crease lines are configured to encourage bending at the crease lines. For instance, in various embodiments, the crease lines may be formed by placing indentations in the blank 100, by partial cuts through the body of the blank 100, by placing serrated indentations in the body of the blank 100 that include alternating sections of cuts through the body of the blank and sections without cuts, and/or combinations thereof.

For convenience, the blank 100 is shown in FIG. 1 as a single flat item that may be manufactured as a single piece. However, it should be apparent to one of ordinary skill in the art in light of this disclosure that the blank 100 may be manufactured into multiple pieces that may be adhered to one another through such mechanisms as tape, glue, staples, etc., and/or a combination thereof prior to carrying out the sequence of folding steps to make the garment box. In addition, according to various embodiments, the blank 100 may be constructed of any suitable material such as, for example, paperboard or cardboard.

The blank 100 includes a bottom panel 127, a first side wall 120, a second side wall 123, a third side wall 124, and a fourth side wall 128. Dimensions for the bottom panel 127 and the first, second, third, and fourth side walls 120, 123, 124, 128 may vary among embodiments. For instance, in one embodiment, the bottom panel 127 measures approximately 27.25 inches by 50 inches, the first and fourth side walls 120, 128 measure approximately 5 inches by 37.75 inches, and the second and third side walls 123, 124 measure approximately 5 inches by 60 inches. A container portion of the garment box for holding the garments may be formed by folding the first side wall 120 along a crease line 121 between the first side wall 120 and the bottom panel 127 at an approximate right angle and folding the fourth side wall 128 along a crease line 129 between the fourth side wall 128 and the bottom panel 127 at an approximate right angle so that the first side wall 120 and the fourth side wall 128 are substantially parallel to and facing one another. The second side wall 123 is folded along the crease line 125 between the second side wall 123 and the bottom panel 127 at an approximate right angle and the third side wall 124 is folded along a crease line 126 between the third side wall 124 and the bottom panel 127 at an approximate right angle so that the second side wall 123 and the third side wall 124 are substantially parallel to and facing one another. In the embodiment shown in FIG. 1, the first side wall 120 includes tabs 114, 118 at each end of the wall 120. Each tab 114, 118 is formed by a crease line 130, 131 located at the bottom of the tab 114, 118 between the tab 114, 118 and the remaining body of the first side wall 120. In a particular embodiment, the crease line 130, 131 for each tab 114, 118 is located approximately 5 inches in from the edge of the tab 114, 118 that runs substantially parallel with the second and third side walls 123, 124. In addition, each tab 114, 118 is formed by a slit 119, 122 that separates the tab 114, 118 from the second side wall 123 and the third side wall 124. In a particular embodiment, the slit 119, 122 for each tab 114, 118 is located approximately 5 inches in from the edge of the tab 114, 118 that runs substantially parallel with the with the first side wall 120. Thus, during the forming of the container portion of the garment box, the tab 114, 118 on each side of the first side wall 120 is folded along the crease 130, 131 at an approximate right angle and is placed inside the second side wall 123 or the third side wall 124, depending on the tab 114, 118. According to various embodiments, the tabs 114, 118 may be secured to the second side wall 123 and/or the third side wall 126 using various adhesion mechanisms such as tape, glue, staples, etc., and/or a combination thereof. In the embodiment shown in FIG. 1, the fourth side wall 128 includes a similar tab configuration as the first side wall 120.

In various embodiments, at least one of the first side wall 120 and the fourth side wall 128 includes a walled enclosure portion 101, 135 that is used to secure the heads of one or more hangers. However, in a preferred embodiment, both the first side wall 120 and the fourth side wall 128 include a walled enclosure portion 101, 135 because such a configuration may permit an alternate layering arrangement of garments within the container portion of the formed garment box that may facilitate a wrinkle free, non-slippage shipment of the garments within the garment box.

As mentioned, the walled enclosure portion 101, 135, once formed, serves as an enclosure for securely holding in place the heads of one or more hangers during the handling and shipping process. As is described in greater detail below, garments are placed on the hangers, and the hangers are packed into the formed garment box with the heads of the hangers secured within the walled enclosure portion 101, 135. As a result, in various embodiments, the garments packed into the garment box are discouraged from sliding around inside the box during the handling and shipping process.

In various embodiments, the walled enclosure portion 101, 135 includes a first fold over panel 104, a second fold over panel 108, and a third fold over panel 115. The first fold over panel 104 is substantially rectangular in shape and includes two tabs 102, 107 at each end of the length of the panel 104. For instance, in one particular embodiment, the first fold over panel 104 measures approximately 6 inches by 27.75 inches. Each tab 102, 107 includes a crease line 103, 106 located at the bottom of the tab 102, 107 between the tab 102, 107 and the remaining body of the first fold over panel 104. For example, in one embodiment, the crease line 103, 106 for each tab 102, 107 measures approximately 5.5 inches in from the end of the first fold over panel 104. Further, the first fold over panel 104 includes a hole 105 located proximate the mid-point of the panel 104 between the two tabs 102, 107 and off-center in a direction away from the interior portion of the blank 100. For instance, in one embodiment, the hole 105 may be approximately round in shape with a radius of approximately 0.75 inches. However, in other embodiments, the hole 105 may be other shapes such as oval. Further, the hole 105 may be located approximately 1.75 inches in from the outside edge of the first fold over panel 104 according to one embodiment. As is described in greater detail below, the hole 105 may be used to support a rod that is inserted into the walled enclosure portion 101, 135 of the formed garment box on which the heads of the hangers are hung.

In various embodiments, the second fold over panel 108 is substantially rectangular in shape and is located at the inside edge of the first fold over panel 104. A crease line 109 is located between the first fold over panel 104 and the second fold over panel 108. In particular embodiments, the length of the second fold over panel 108 is approximately less than the length of the crease line 121 located between the first side wall 120 and the bottom panel 122. For instance, in one embodiment, the second fold over panel 108 measures approximately 5 inches by 26.75 inches. This is so that the second fold over panel 108 fits inside of the container portion of the garment box during carrying out the sequence of folding steps upon the blank 100.

In the particular embodiment shown in FIG. 1, the crease line 109 along the first fold over panel 104 and the second fold over panel 108 is slightly less than the length of the second fold over panel 108. For instance, in one embodiment, the crease line 109 measures approximately 25.75 inches. Further, in the particular embodiment shown in FIG. 1, slits 132, 133 are located at each end of the crease line 109 between the first fold over panel 104 and the second fold over panel 108 that separate the two panels 104, 108 from one another. These slits 132, 133 may be of varying lengths (e.g., approximately 0.5 inches) and allow the tabs 102, 107 of the first fold over panel 104 to be folded along the crease lines 103, 107 at an approximate right angle so that the tabs 102, 107 are substantially parallel to and facing one another and so that the tabs 102, 107 fit inside the length of the second fold over panel 108 during carrying out the sequence of folding steps upon the blank 100.

In addition, in various embodiments, the second fold over panel 108 includes a transverse slot 112 extending across the second fold over panel 108 in a width direction. The slot 112 is located proximate the mid-point of the second fold over panel 108 and is substantially aligned with the hole 105 located in the first fold over panel 102. In one embodiment, the width of the slot 112 measures approximately 1.25 inches. The slot 112 is sized and positioned to accommodate the necks of hangers once the heads of the hangers have been secured in the walled enclosure portion 101, 135 of the formed garment box. In particular embodiments, the head of a hanger may be inserted into the slot 112 and then twisted approximately ninety (90) degrees so that the hanger may lie flat within the container portion of the garment box. Further, in particular embodiments, the second fold over panel 108 may include a slit 134 disposed at the terminal end of the slot 112 proximate a crease line 110 between the second fold over panel 108 and the third fold over panel 115. The slit 134 may be extended approximately parallel with the crease line 110 and may be extended beyond the edge of the slot 112. For instance, in one embodiment, the slit measures approximately 5.75 inches. The slit 134 provides space so that the head of a hanger may pass through the slit 134 and may be secured in the walled enclosure portion 101.

In various embodiments, the third fold over panel 115 is substantially rectangular in shape and is located between the second fold over panel 108 and the outside edge of the first side wall 120. As mentioned, a crease line 110 is located between the second fold over panel 108 and the third fold over panel 115. In particular embodiments, the length of the third fold over panel 108 is less than the length of the second fold over panel 108. For instance, in one embodiment, the third fold over panel 115 measures approximately 6.75 inches by 20.75 inches. This may provide clearance so that the tabs 102, 107 on the first fold over panel 104 and the tabs 114, 118 on the first side wall fit properly in the walled enclosure portion 101 once the box is assembled from the blank 100. Further, a crease line 117 is located between the third fold over panel 115 and the first side wall 120. In various embodiments, the crease line 117 runs the length of the third fold over panel 115.

Finally, the third fold over panel 115 includes a hole 116 located proximate the mid-point of the panel 115 and off center closer to the bottom panel 127 in a width direction. Similar to the hole 105 in the first fold over panel 104, in one embodiment, the hole 116 may be approximately round in shape with a radius of approximately 0.75 inches. However, in other embodiments, the hole 116 may be other shapes such as oval. Further, the hole 116 may be located approximately 1.75 inches in from the edge of the third fold over panel 115 nearest the first side wall 120 according to one embodiment. Similar to the hole 105 in the first fold over panel 104, the hole 116 may be used to support a rod that is inserted into the walled enclosure portion 101, 135 of the formed garment box on which the heads of the hangers are hung.

As previously mentioned, in various embodiments, a second walled enclosure 135 may be present at the fourth side wall 128 of the formed garment box. The second walled enclosure 135 is constructed similarly to the first walled enclosure portion 101. Thus, in these particular embodiments, the constructed garment box has a walled enclosure portion 101, 135 at each end of the box. As a result, garments may be placed in the garment box with the hanger for each garment being secured in one of the two walled enclosure portions 101, 135. In various embodiments, such a configuration may allow for more garments to be placed for shipping in the garment box.

Figure 11:
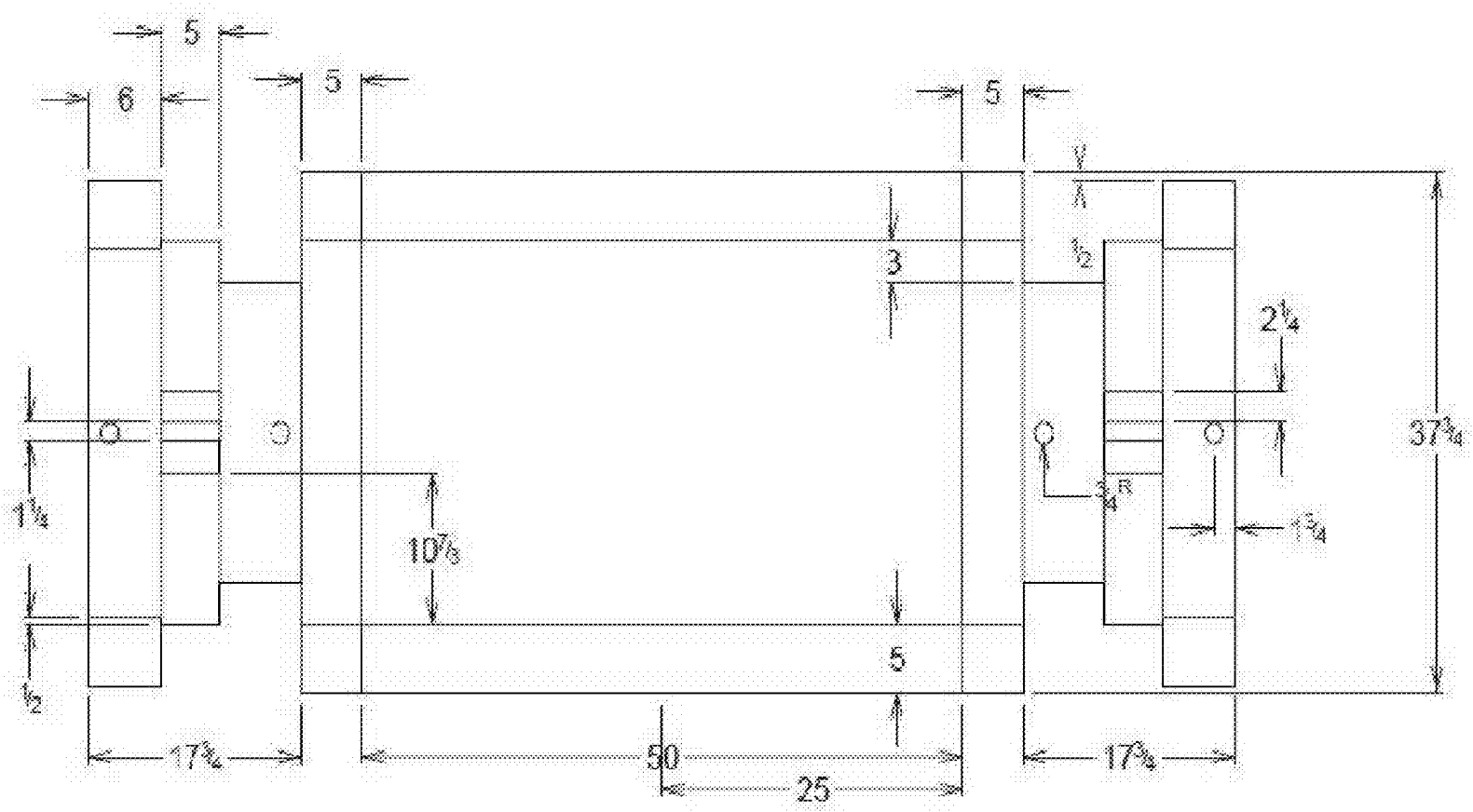
FIG. 11 shows a top view of an arrangement of a blank used to make a garment box along with accompanying dimensions according to an embodiment of the invention.

FIG. 11 provides a top view of an arrangement of a blank used to make a garment box along with accompanying dimensions according to an embodiment of the invention.

II. Method of Assembly

FIGS. 2-6 provide an illustration of an assembly of the garment box from a blank 100 according to an embodiment of the invention. Looking at FIG. 2, the blank 100 displayed in this figure is virtually the same blank 100 described in FIG. 1. The assembly of the garment box is performed by carrying out a sequence of folding steps upon the blank 100. The sequence of folding steps is explained as set forth below according to one embodiment of the invention. However, it should be noted that the sequence of folding steps need not necessarily be performed in the order provided in the explanation given below. For instance, one may perform the folding steps relating to forming the container portion of the garment box prior to performing the folding steps for the walled enclosure portions 101, 135 or vice versa. Thus, the particular sequence of folding steps provided below are for illustrative purposes only and should not be construed to limit the scope of the claimed invention.

An individual performing the sequence of folding steps may begin by folding the tabs 102, 107 on the first fold over panel 104 inward along the crease lines 103, 106 towards the center of the panel 104 until the tabs 102, 107 are at approximate right angles and facing one another. The individual may continue by folding the first fold over panel 104 inward towards the center of the blank 100 along the crease line 109 so that the tabs 102, 107 are traveling towards the center of the blank 100. The individual may then continue by folding the second fold over panel 108 in the same direction as the first fold over panel 104 along the crease line 110. In addition, the individual may continue by folding the third fold over panel 115 in the same direction as the first fold over panel 104 and the second fold over panel 108 along the crease line 117.

Virtually simultaneously or following the sequence of steps for folding the first, second, and third fold over panels 104, 108, 115, the individual may fold the first side wall 120 in the same direction as the first fold over panel 104, the second fold over panel 108, and the third fold over panel along the crease line 121 that lies between the first side wall 120 and the bottom panel 127 of the blank 100. Thus, the individual performs the sequence of folding steps for the walled enclosure portion 101 that results in a "rolling up" effect of the first, second, and third fold over panels 104, 108, 115 and the first side wall 120 with the first, second, and third fold over panels 104, 108, 115 folded onto each other along the crease lines 109, 110, 117 as shown in FIGS. 3-6. As a result of this sequence of folds, the walled enclosure portion 101 is formed by the first, second, and third fold over panels 104, 108, 115 and the first side wall 120.

Figure 7:
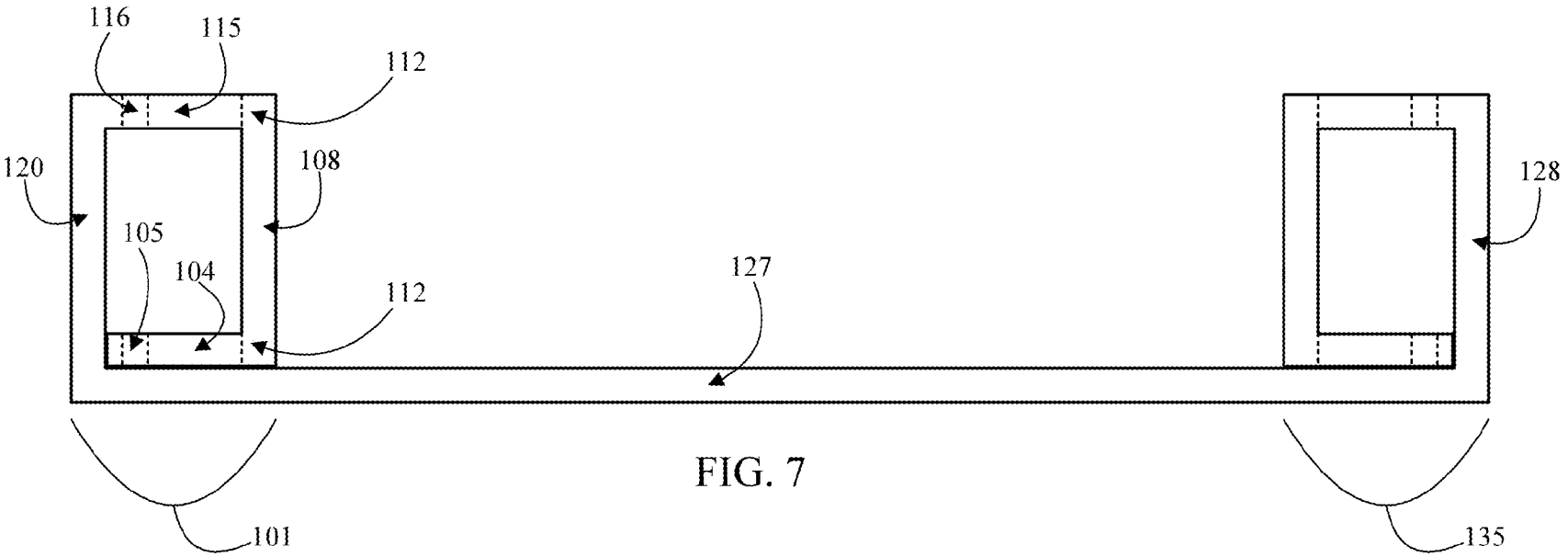
FIG. 7 shows a cross-section view of a garment box according to an embodiment of the invention.

A cross-section of a garment box is shown in FIG. 7 with a walled enclosure portion 101, 135 located just inside the first and fourth side walls 120, 128. As shown in the figure, the first, second, and third fold over panels 104, 108, 115 have been folded to form the walled enclosure portion 101 inside the first side wall 120. Further, the holes 105, 116 located in the first and third fold over panels 104, 115 and the slot 112 located in the second fold over panel 108 are shown.

It should be noted that in the embodiments in which the blank 100 is configured with a walled enclosure portion 101, 135 at each end of the blank 100, the sequence of folding steps described above with respect to a first of the walled enclosure portions 101 is performed for the second of the walled enclosure portion 135 at substantially the same time, proceeding, or following the sequence of folding steps being completed for the first of the walled enclosure portions 101.

Further, at substantially the same time, proceeding, or following the sequence of folding steps being completed for the first and/or second walled enclosure portions 101, 135, the individual may fold the second and third side walls 123, 124 inward toward the center of the blank 100. It should also be noted that in various embodiments, the individual performing the sequence of folding steps folds the tabs 114, 118 located on the first side wall 120 and/or the fourth side wall 128 along the crease lines 130, 131, in a similar fashion to the tabs 102, 107 on the first fold over panel, so that the tabs 130, 131 are at approximate right angles and facing one another. Further, in various embodiments, these tabs 130, 131 are positioned inside the second and the third side walls 123, 124, respectively. In addition, in various embodiments, the individual performing the sequence of folding steps may attach the tabs 130, 131 to the second and third side walls 123, 124 using such mechanisms as tape, glue, staples, etc., and/or combination thereof.

Once the individual has performed the sequence of folding steps for a particular walled enclosure portion 101, 135, the first fold over panel 104, is positioned inside the walled enclosure portion 101, 135 and the panel 104 lays juxtaposition and on top of the bottom panel 127 of the formed garment box. In particular embodiments, the tabs 102, 107 on the first fold over panel 104 may be positioned inside the tabs 114, 118 of the first and/or fourth side walls 120, 128. As previously described, such a configuration may result from the offset slits 132, 133 provided for the tabs 102, 107 on the first fold over panel 104. In various embodiments, these tabs 102, 107 may be attached to the tabs 114, 118 of the first and/or fourth side walls 120, 128 and/or directly to the first and/or fourth side walls 120, 128, themselves. Again, the tabs 102, 107 may be attached using such mechanisms as tape, glue, staples, etc., and/or combination thereof.

Further, once the sequence of folding steps has been performed for a particular walled enclosure portion 101, 135, the second fold over panel 108 is positioned approximately perpendicular to the bottom panel 127 of the formed garment box. In particular embodiments, the slot 112 in the second fold over panel 108 runs approximately from the bottom panel 127, across the width of the second fold over panel 108, to the top of the container portion of the garment box. As previously described, the slot 112 is configured to accommodate the neck portions of hangers once the heads of the hangers have been secured in the particular walled enclosure portion 101, 135. Further, the third fold over panel 115 is positioned substantially parallel to and facing the first fold over panel 104 and the bottom panel 127.

Figure 8:
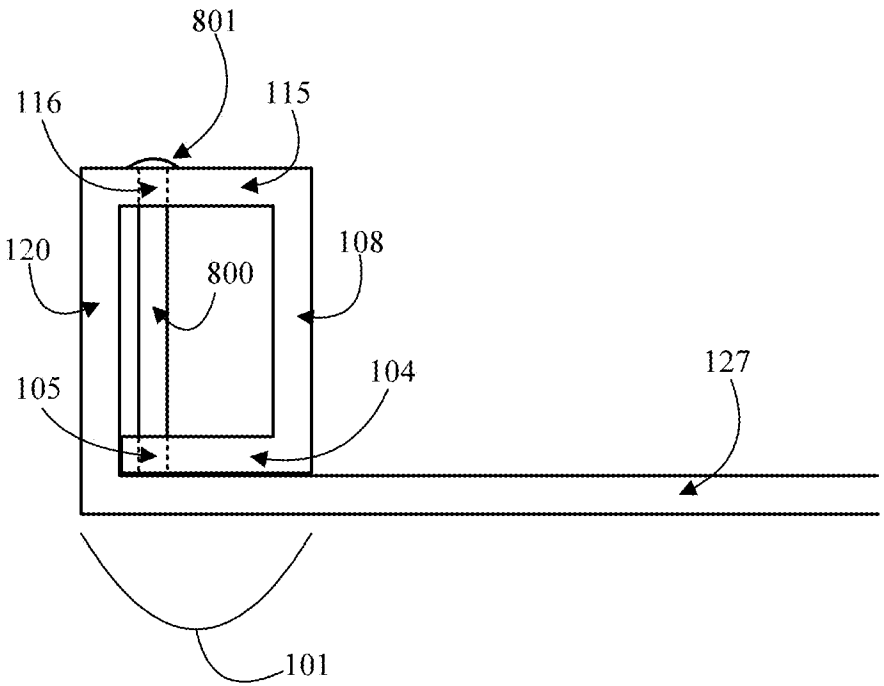
FIG. 8 shows a cross-section view of a walled enclosure portion according to an embodiment of the invention.

In particular embodiments, the hole 105 in the first fold over panel 104 and the hole 116 in the third fold over panel 115 are substantially aligned to one another so that a rod may be inserted into the hole 116 in the third fold over panel 115 that passes through the body of the particular walled enclosure portion 101, 135 and comes to rest in the hole 105 in the first fold over panel 104. Such a configuration is displayed in FIG. 8. As shown, the rod 800 is inserted into the hole 116 in the third fold over panel 115 and passes through the body of the walled enclosure portion 101 and comes to rest in the hole 105 in the first fold over panel 104. Further, in various embodiments, the rod 800 may be configured with a sealing mechanism 801. This sealing mechanism 801 may be used to better secure the rod 800 inserted into the walled enclosure portion 101. A number of different mechanisms may be used such as tape, a sticker, a cap, etc., and/or combination thereof. Further, the sealing mechanism 801 may be attached to the rod 800 or may be placed over the rod 800 once inserted into the wall enclosure portion 101 according to various embodiments.

Figure 9:
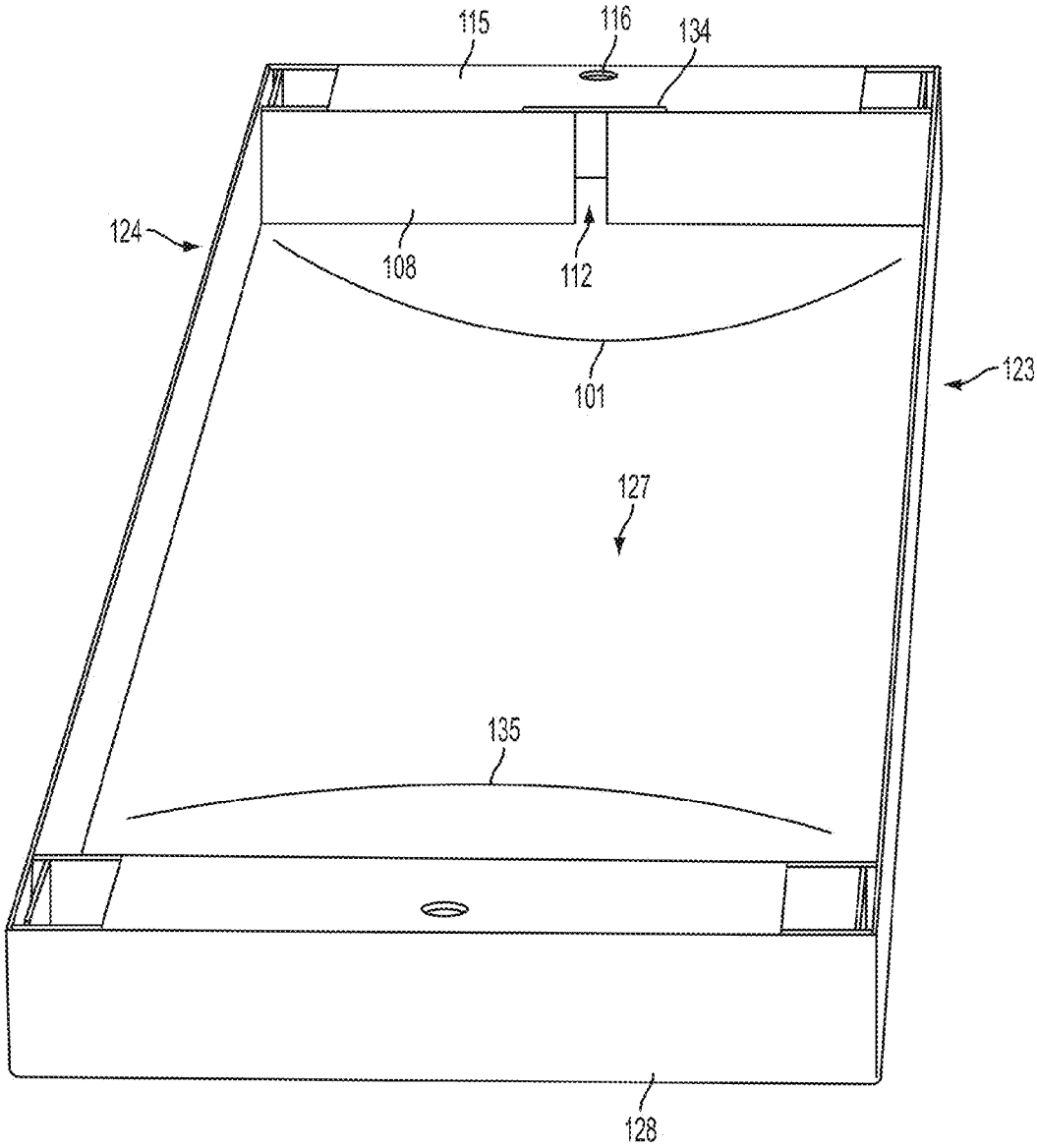
FIG. 9 shows a perspective view of a garment box according to an embodiment of the invention.

This rod 800 may be used to rest the heads of the hangers around in order to secure the heads in the walled enclosure portion 101, 135. Further, in particular embodiments, the slot 112 in the second fold over panel 108 is configured to be substantially aligned with the rod 800 inserted into the walled enclosure portion 101, 135 so that the necks on the hangers secured using the rod 800 may extend through the slot 112 with the bodies of the hangers being in the container portion of the garment box. A perspective view of a completed garment box (without the rod 800 being inserted) is shown in FIG. 9. In this view, one can see the two walled enclosure portions 101, 135 located on opposite sides of the container portion of the garment box.

Finally, in various embodiments of the configuration, a slit 134 may be disposed along the crease line 110 between the second fold over panel 108 and the third fold over panel 115 and may extend parallel with the crease line 110. This slit 134 may be positioned over the slot 112 in the second fold over panel 108 and, in these particular embodiments, may be configured to accommodate the head of a hanger so that the head may pass through the slit 134 and be placed on the rod in the walled enclosure portion 101, 135.

III. Configuration of Garment Box and Use

As mentioned above, FIG. 9 displays a constructed garment box according to an embodiment of the invention. This particular embodiment of the garment box includes two walled enclosure portions 101, 135 located at each end of the garment box. As can be seen in the figure, the third fold over panel 115 of each of the walled enclosure portions 101, 135 includes a hole 116 through which a rod may be inserted. In addition, the second fold over panel 108 of each of the walled enclosure portions 101, 135 includes a traverse slot 112 extending across the second fold over panel 108 in a width direction and a slit 134 extending along a portion of the edge between the second fold over panel 108 and the third fold over panel 115 and positioned over the slot 112. Finally, the container portion of the garment box is formed by the first, second, third, and fourth side walls 120, 123, 124, 128. The area for holding the garments in the container portion has a width that runs substantially from the second side wall 123 to the third side wall 124 and a length that runs substantially from the edge of the third fold over panel 115 for the first walled enclosure portion 101 to the edge of the third fold over panel for the second walled enclosure portion 135. The slot, slit, and third fold over panel of the second walled enclosure portion 135 are not pictured in FIG. 9.

To use the garment box, an individual places garments on hangers (such as, for example, a suit on a hanger) one at a time into the container portion of the box. This may be accomplished in various embodiments by the individual inserting the head of the hanger into the slot 112 and then twisting the head approximately ninety (90) degrees so that the head may be placed around the rod 800 in the walled enclosure portion 101, 135 so that the garment may lie flat within the container portion of the box. In addition, in particular embodiments in which the walled enclosure portion 101, 135 is provided with a slit 134 positioned above the slot 112 in the walled enclosure portion 101, 135, the individual may insert the hanger head through the slit 134 and place the head of the hanger around the rod so that the garment may lie flat within the container portion of the box. In various embodiments, the rod may be inserted into the walled enclosure portion 101, 135 prior to the heads of the hangers being inserted into the walled enclosure portion 101, 135 or after the heads of the hangers have been inserted into the walled enclosure portion 101, 135. Further, in various embodiments, the garment may be placed in the container portion of the garment box so that the heads of the hangers are alternated between the two walled enclosure portions 101, 135. This may be done in order to maximize the number of garments that may be placed in the garment box.

Figure 10:
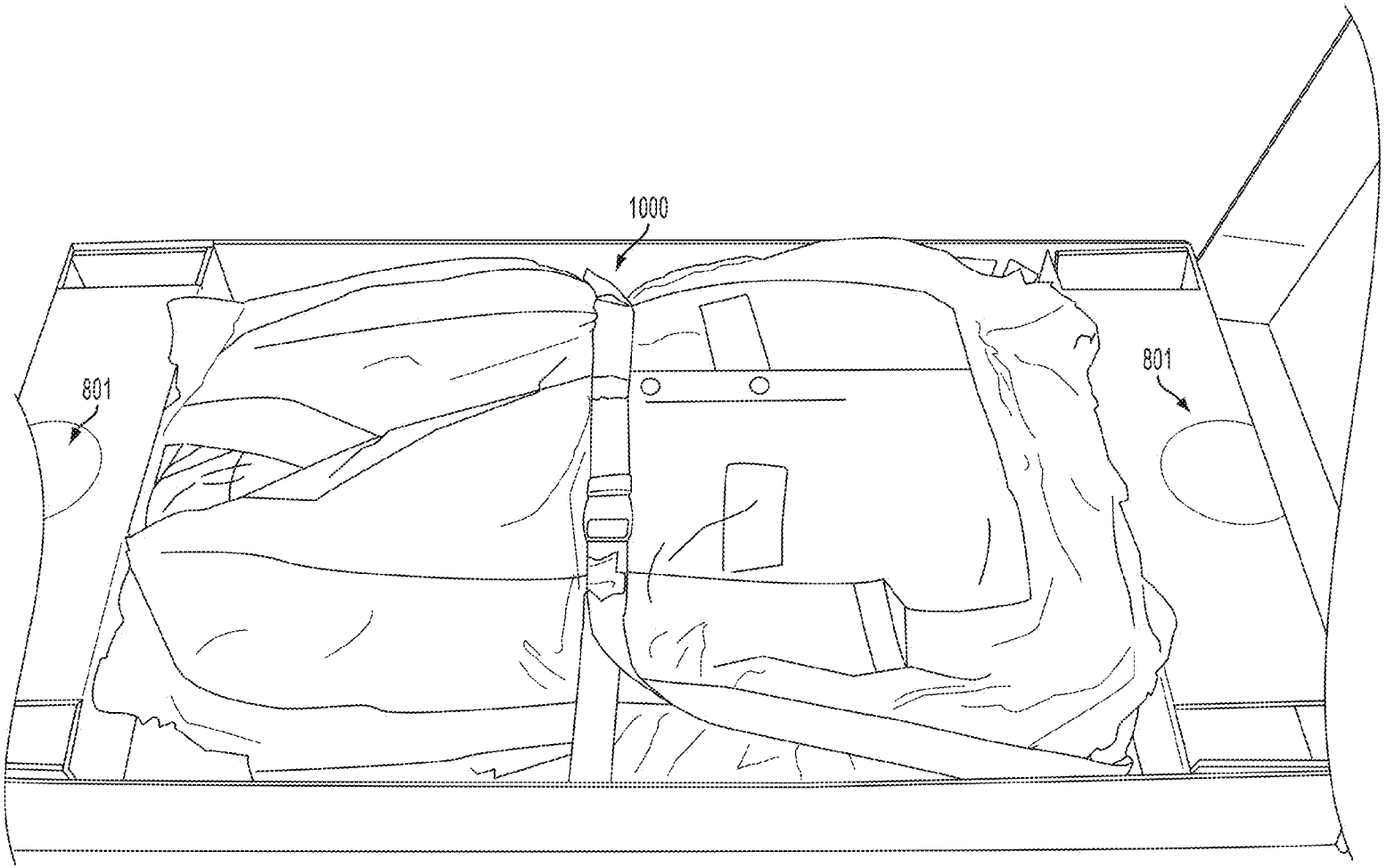
FIG. 10 shows a top view of a garment box packed with garments according to an embodiment of the invention.

FIG. 10 shows a top view of an embodiment of a garment box that has been packed with garments. One can see that the garments have been placed in the container portion of the box so that the heads for the hangers alternate between being secured in the walled enclosure portions 101, 135. In addition, in this particular embodiment, a sealing mechanism 801 (as previously described) has been placed over the holes 116 in the third fold over panels 115 of the two walled enclosure portions 101, 135. Further, it should be noted that such a sealing mechanism 801 may not be needed in various embodiments. Finally, in this particular embodiment, a strap 1000 may be used to further secure the garments in the container portion 700 of the garment box. The strap 1000 may be attached to the box or may be free from the box and may simply be placed around the garments packed into the box. The strap 1000 may be secured using various mechanisms such as buckets, clips, snaps, etc., and/or combinations thereof. In addition, various embodiments may employ other mechanisms such as belts, ties, etc., and/or combination thereof or may not employ such a mechanism.

Once the garments have been placed into the container portion of the garment box, a lid may be placed over the box prior to shipping in various embodiments. In particular embodiments, the lid may be secured to the box by using such mechanisms as tape, glue, staples, etc. and/or combination thereof. In addition, in other embodiments, other packaging materials besides and/or in addition to a lid may be used to further secure the garments in the box such as wrapping the box with paper, foam, bubble wrap, a bag, etc., and/or combination thereof. As a result, in various embodiments, the garment box may travel in a number of different orientations during shipping without the garments becoming curled up, disarranged, disheveled, and/or wrinkled.

IV. Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A garment box comprising:

(1) a bottom panel;

(2) a container portion comprising a first side wall, a second side wall, a third side wall, and a fourth side wall, wherein:

(a) the first side wall, the second side wall, the third side wall, and the fourth side wall are adjacent to and at approximate right angles to the bottom panel;

(b) the first side wall and the fourth side wall are on opposite sides of the bottom panel from one another and are substantially parallel to and facing one another; and (c) the second side wall and the third side wall are on opposite sides of the bottom panel from one another, are adjacent to the first side wall and the second side wall, and are substantially parallel to and facing one another; and (3) contiguous to the first side wall, a walled enclosure portion, wherein the walled enclosure portion comprises:

(a) a first fold over panel comprising a hole located proximate a mid-point of the first fold over panel, the hole configured to support a rod that is inserted into the walled enclosure portion on which one or more heads of clothes hangers are hung;

(b) a second fold over panel adjacent an inside edge of the first fold over panel and at an approximate right angle to the first fold over panel comprising a transverse slot extending a width of the second fold over panel and located proximate a mid-point of the second fold over panel and approximately aligned with the hole located in the first fold over panel, the transverse slot being configured so that the one or more heads of the clothes hangers can be inserted and placed around the rod so that the one or more heads of the clothes hangers are secured during handling and shipping of the garment box; and (c) a third fold over panel adjacent an inside edge of the second fold over panel and adjacent an outside edge of the first side wall and at an approximate right angle to the second fold over panel and the outside edge of the first side wall, the third fold over panel comprising a hole located proximate a mid-point of the third fold over panel, the hole configured to support the rod that is inserted into the walled enclosure portion on which the one or more heads of the clothes hangers are hung, wherein interposition of the first, second, and third fold over panels forms the walled enclosure portion such that:

(1) the first fold over panel is positioned inside the walled enclosure portion and lays juxtaposition on top of the bottom panel;

(2) the second fold over panel is positioned approximately perpendicular to the bottom panel and comprises a width that extends approximately from the bottom panel to a top of the walled enclosure portion;

(3) the third fold over panel is positioned approximately parallel to and facing the first fold over panel and on an opposite side of the width of the second fold over panel from the first fold over panel; and (4) the hole in the first fold over panel and the hole in the third fold over panel are approximately aligned with one another so that the rod can be inserted into the hole in the third fold over panel and passed through the walled enclosure portion and come to rest in the hole in the first fold over panel.

2. The garment box of claim 1, wherein the garment box is manufactured as a blank comprising a single piece.

3. The garment box of claim 1 further comprising:

(4) contiguous to the fourth side wall, a second walled enclosure portion, wherein the second walled enclosure portion comprises:

(a) a first fold over panel comprising a hole located proximate a mid-point of the first fold over panel, the hole configured to support a rod that is inserted into the second walled enclosure portion on which one or more heads of clothes hangers are hung;

(b) a second fold over panel adjacent an inside edge of the first fold over panel and at an approximate right angle to the first fold over panel comprising a transverse slot extending a width of the second fold over panel and located proximate a mid-point of the second fold over panel and approximately aligned with the hole located in the first fold over panel, the transverse slot being configured so that the one or more heads of the clothes hangers can be inserted and placed around the rod so that the one or more heads of the clothes hangers are secured during handling and shipping of the garment box; and (c) a third fold over panel adjacent an inside edge of the second fold over panel and adjacent an outside edge of the fourth side wall and at an approximate right angle to the second fold over panel and the outside edge of the fourth side wall, the third fold over panel comprising a hole located proximate a mid-point of the third fold over panel, the hole configured to support the rod that is inserted into the second walled enclosure portion on which the one or more heads of the clothes hangers are hung, wherein interposition of the first, second, and third fold over panels forms the second walled enclosure portion such that:

(1) the first fold over panel is positioned inside the second walled enclosure portion and lays juxtaposition on top of the bottom panel;

(2) the second fold over panel is positioned approximately perpendicular to the bottom panel and comprises a width that extends approximately from the bottom panel to a top of the second walled enclosure portion;

(3) the third fold over panel is positioned approximately parallel to and facing the first fold over panel and on an opposite side of the width of the second fold over panel from the first fold over panel; and (4) the hole in the first fold over panel and the hole in the third fold over panel are approximately aligned with one another so that the rod can be inserted into the hole in the third fold over panel and passed through the second walled enclosure portion and come to rest in the hole in the first fold over panel.

4. The garment box of claim 1 further comprising a sealing mechanism configured to be placed over the hole in the third fold over panel to secure the rod inserted into the walled enclosure portion.

5. The garment box of claim 1 further comprising a sealing mechanism configured to secure the rod inserted into the walled enclosure portion.

6. The garment box of claim 1, wherein the second fold over panel comprises a slit disposed at a terminal end of the transverse slot proximate the inside edge of the second fold over panel, the slit configured to provide space so that a head of a hanger can pass through the slit and be secured in the walled enclosure portion.

7. The garment box of claim 1 further comprising a strap configured to secure garments placed in the container portion of the garment box.

8. A method for making a garment box, wherein the garment box comprises: a bottom panel and a container portion comprising a first side wall, a second side wall, a third side wall, and a fourth side wall, each adjacent to the bottom panel, the first side wall and the fourth side wall being on opposite sides of the bottom panel from one another, the second side wall and the third side wall being on opposite sides of the bottom panel from one another, and adjacent to the first side wall and the second side wall; and contiguous to the first side wall, a walled enclosure portion comprising: a first fold over panel comprising a hole located proximate a mid-point of the first fold over panel, a second fold over panel adjacent an inside edge of the first fold over panel and comprising a transverse slot extending a width of the second fold over panel and located proximate a mid-point of the second fold over panel and approximately aligned with the hole located in the first fold over panel, and a third fold over panel adjacent an inside edge of the second fold over panel and adjacent an outside edge of the first side wall and comprising a hole located proximate a mid-point of the third fold over panel, the method comprising the steps of:

(a) folding the first side wall, the second side wall, the third side wall, and the fourth side wall approximate right angles to the bottom panel so that the first side wall and the fourth side wall are substantially parallel to and facing one another and the second side wall and the third side wall are substantially parallel to and facing one another; and (b) forming the walled enclosure portion by performing the sub-steps of:

(1) folding down the first fold over panel so that the first fold over panel is positioned inside the walled enclosure portion and lays juxtaposition on top of the bottom panel;

(2) folding down the second fold over panel so that the second fold over panel is positioned approximately perpendicular to the bottom panel and comprises a width that extends approximately from the bottom panel to a top of the walled enclosure portion; and (3) folding down the third fold over panel so that the third fold over panel is positioned approximately parallel to and facing the first fold over panel and on an opposite side of the width of the second fold over panel from the first fold over panel, wherein the hole in the first fold over panel and the hole in the third fold over panel are approximately aligned with one another so that a rod can be inserted into the hole in the third fold over panel and passed through the walled enclosure portion and come to rest in the hole in the first fold over panel, and the transverse slot is configured so that one or more heads of clothes hangers can be inserted through the transverse slot and placed around the rod so that the one or more heads of the clothes hangers are secured during handling and shipping of the garment box.

9. The method of claim 8, wherein the garment box further comprises, contiguous to the fourth side wall, a second walled enclosure portion comprising: a first fold over panel comprising a hole located proximate a mid-point of the first fold over panel, a second fold over panel adjacent an inside edge of the first fold over panel and comprising a transverse slot extending a width of the second fold over panel and located proximate a mid-point of the second fold over panel and approximately aligned with the hole located in the first fold over panel, and a third fold over panel adjacent an inside edge of the second fold over panel and adjacent an outside edge of the fourth side wall and comprising a hole located proximate a mid-point of the third fold over panel, the method further comprising the steps of:

forming the second walled enclosure portion by performing the sub-steps of:

(1) folding down the first fold over panel so that the first fold over panel is positioned inside the second walled enclosure portion and lays juxtaposition on top of the bottom panel;

(2) folding down the second fold over panel so that the second fold over panel is positioned approximately perpendicular to the bottom panel and comprises a width that extends approximately from the bottom panel to a top of the second walled enclosure portion; and (3) folding down the third fold over panel so that the third fold over panel is positioned approximately parallel to and facing the first fold over panel and on an opposite side of the width of the second fold over panel from the first fold over panel, wherein the hole in the first fold over panel and the hole in the third fold over panel are approximately aligned with one another so that a rod can be inserted into the hole in the third fold over panel and passed through the second walled enclosure portion and come to rest in the hole in the first fold over panel, and the transverse slot is configured so that one or more heads of clothes hangers can be inserted through the transverse slot and placed around the rod so that the one or more heads of the clothes hangers are secured during handling and shipping of the garment box.

10. The method of claim 8 further comprising the step of inserting a rod in the hole in the third fold over panel so that the rod passes through the walled enclosure portion and comes to rest in the hole in the first fold over panel.

11. The method of claim 10 further comprising the step of placing a sealing mechanism over the hole in the third fold over panel to secure the rod inserted into the walled enclosure portion.

12. The method of claim 10 further comprising the step of securing the rod inserted into the walled enclosure portion with a sealing mechanism.

13. A blank configured to be used to form a garment box, the blank comprising:

(1) a bottom panel;

(2) a container portion comprising a first side wall, a second side wall, a third side wall, and a fourth side wall, wherein:

(a) the first side wall, the second side wall, the third side wall, and the fourth side wall are adjacent to and configured to bend at approximate right angles to the bottom panel;

(b) the first side wall and the fourth side wall are on opposite sides of the bottom panel from one another and are configured to be substantially parallel to and facing one another upon being bent; and (c) the second side wall and the third side wall are on opposite sides of the bottom panel from one another, are adjacent to the first side wall and the second side wall, and are configured to be substantially parallel to and facing one another upon being bent; and (3) contiguous to the first side wall, a walled enclosure portion, wherein the walled enclosure portion comprises:

(a) a first fold over panel comprising a hole located proximate a mid-point of the first fold over panel;

(b) a second fold over panel adjacent an inside edge of the first fold over panel and configured to bend at an approximate right angle to the first fold over panel, the second fold over panel comprising a transverse slot extending a width of the second fold over panel and located proximate a mid-point of the second fold over panel and approximately aligned with the hole located in the first fold over panel; and (c) a third fold over panel adjacent an inside edge of the second fold over panel and adjacent an outside edge of the first side wall and configured to bend at an approximate right angle to the second fold over panel and the outside edge of the first side wall, the third fold over panel comprising a hole located proximate a mid-point of the third fold over panel, wherein upon the blank being formed into the garment box, interposition of the first, second, and third fold over panels forms the walled enclosure portion such that:

(1) the first fold over panel is positioned inside the walled enclosure portion and lays juxtaposition on top of the bottom panel;

(2) the second fold over panel is positioned approximately perpendicular to the bottom panel and comprises a width that extends approximately from the bottom panel to a top of the walled enclosure portion;

(3) the third fold over panel is positioned approximately parallel to and facing the first fold over panel and on an opposite side of the width of the second fold over panel from the first fold over panel;

(4) the hole in the first fold over panel is configured to support a rod that is inserted into the walled enclosure portion on which one or more heads of clothes hangers are hung;

(5) the transverse slot is configured so that the one or more heads of the clothes hangers can be inserted and placed around the rod so that the one or more heads of the clothes hangers are secured during handling and shipping of the garment box; and (6) the hole in the third fold over panel is approximately aligned with the hole in the first fold over panel so that the rod can be inserted into the hole in the third fold over panel and passed through the walled enclosure portion and come to rest in the hole in the first fold over panel.

14. The blank of claim 13, wherein blank is manufactured as a single piece.

* * * * *